United States Patent [19]

Harris

[11] 4,078,746

[45] Mar. 14, 1978

[54] ACROBATIC ROTARY KITE

[75] Inventor: Coy F. Harris, Lubbock, Tex.

[73] Assignees: Harold E. Schneider; Sigma Engineering Company, Inc., both of Lubbock; Gary Wood, Houston, all of Tex.; a part interest to each

[21] Appl. No.: 790,668

[22] Filed: Apr. 25, 1977

[51] Int. Cl.[2] ..... B64C 31/06

[52] U.S. Cl. ..... 244/153 A; D34/15 AF

[58] Field of Search ..... 244/153 R, 153 A, 155 A, 244/21, 10; 46/74 R, 75, 77; D34/15 AF; 416/4

[56] References Cited

U.S. PATENT DOCUMENTS

| | | | |
|---|---|---|---|
| 2,344,515 | 3/1944 | Massey | 244/21 |
| 3,087,698 | 4/1963 | Mullinix | 244/153 A |
| 3,108,770 | 10/1963 | Mullinix | 244/153 A |

FOREIGN PATENT DOCUMENTS

| | | | |
|---|---|---|---|
| 2,164,916 | 7/1973 | Germany | 244/153 A |
| 272,532 | 3/1930 | Italy | 244/21 |
| 953,276 | 3/1964 | United Kingdom | 244/153 A |

*Primary Examiner*—Galen L. Barefoot
*Attorney, Agent, or Firm*—Ely Silverman

[57] ABSTRACT

The kite structure herein provides for inherent correction for changes in speed of rotation and direction of wind and has self-starting features and structures that minimize the effect of cord and stabilizer contact which, in the overall, provides for easier, more reliable, and more accurate operation then has heretofore been obtained by similar kites and turns usual frustrating failures into satisfying and enjoyable operations.

10 Claims, 24 Drawing Figures

FIG.4
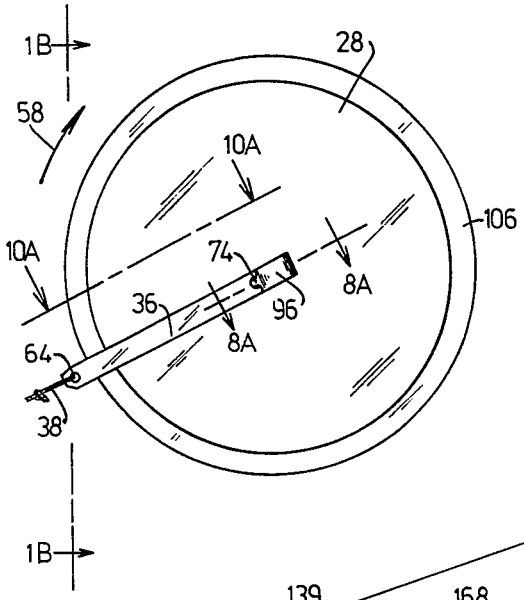
FIG.5
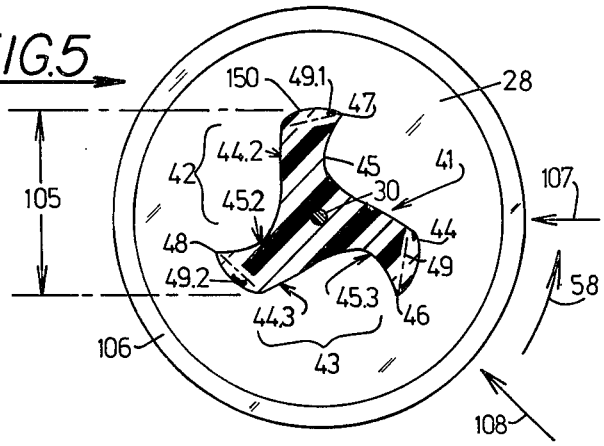
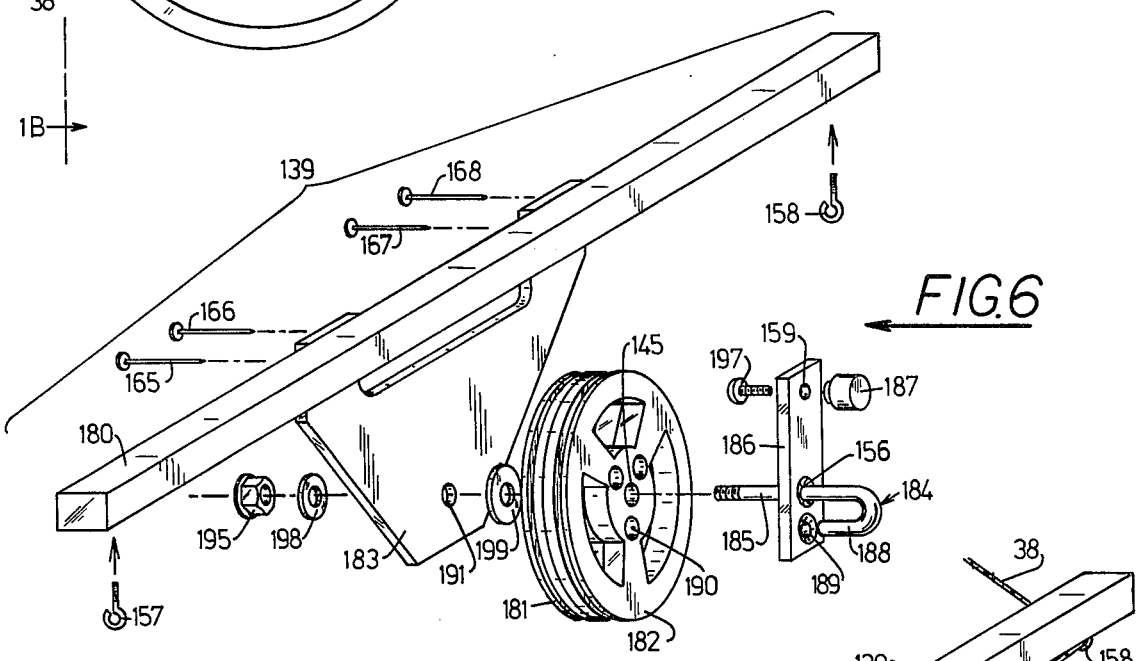
FIG.6
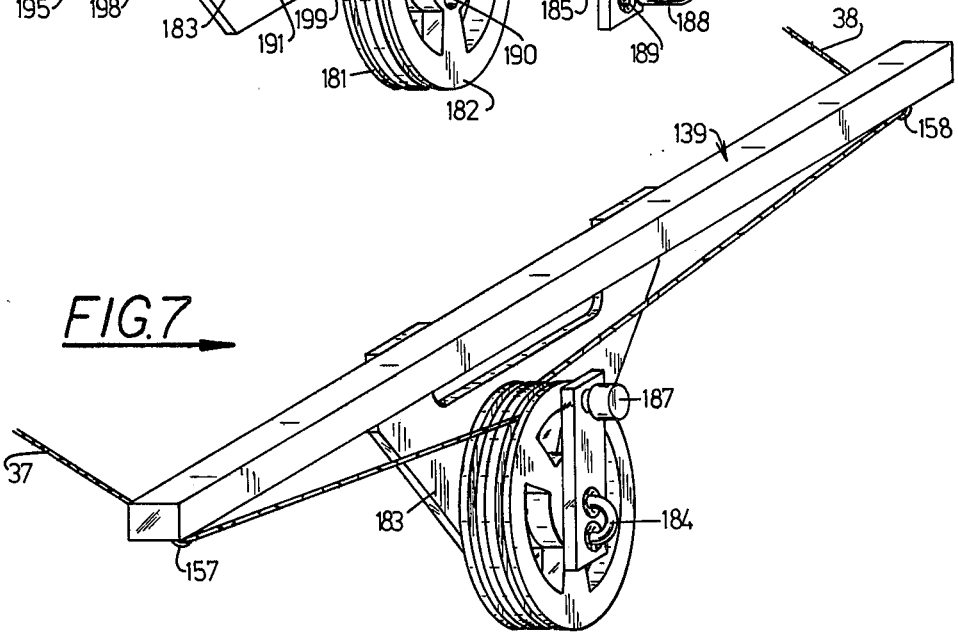
FIG.7

FIG.8
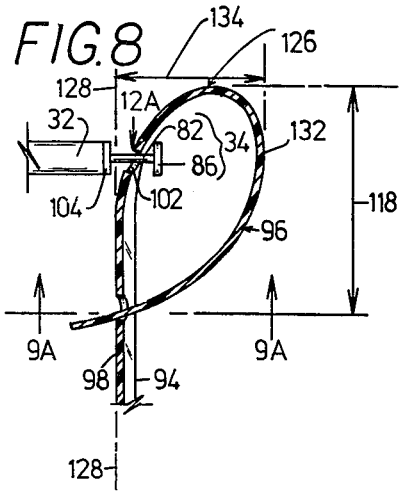
FIG.9
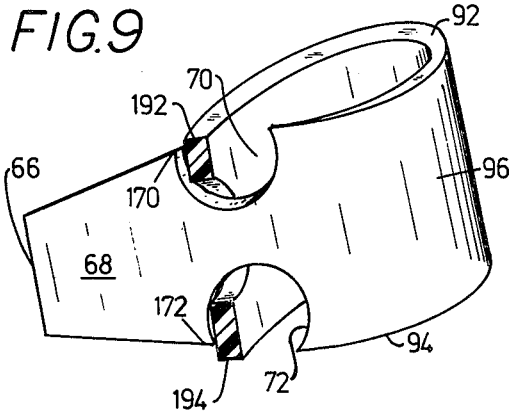
FIG.10
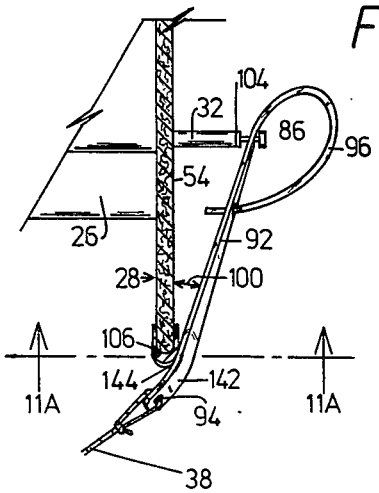
FIG.11
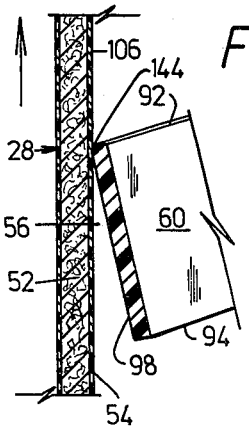
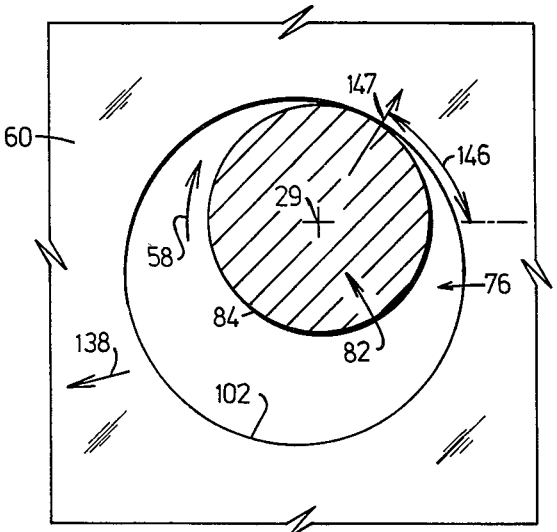
FIG.12
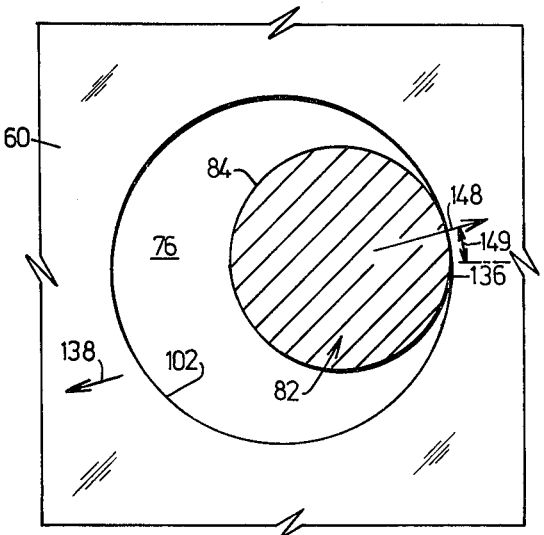
FIG.13

25
27
28
29
2A
38
37
40
141
110
124
114
39
90
18A
111
117
115
101
112
1A
25
173
174
176
163
164
161
162
122
120
116

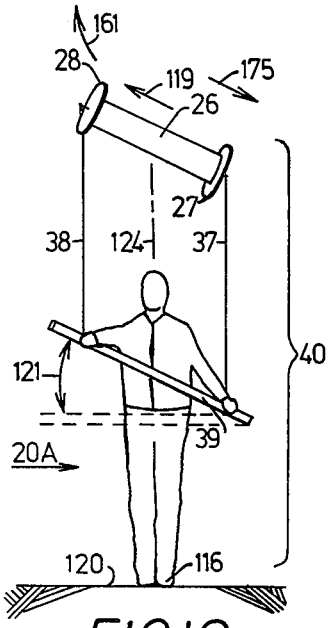
FIG.19
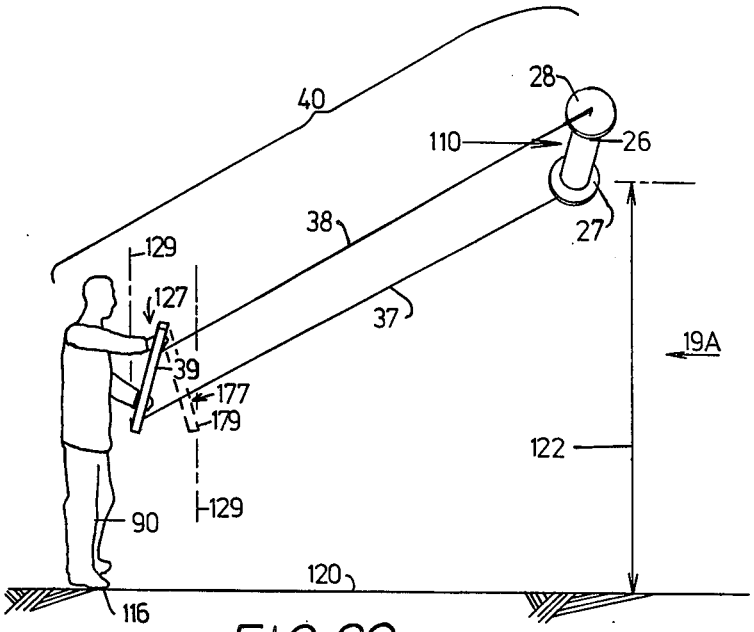
FIG. 20
FIG.21
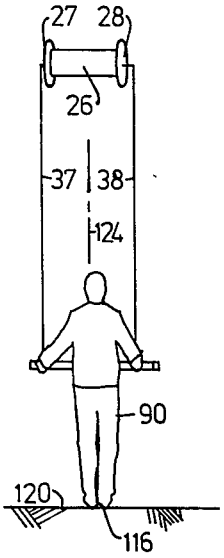
FIG.22
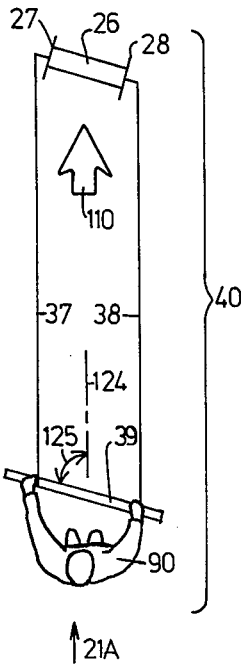
FIG.23
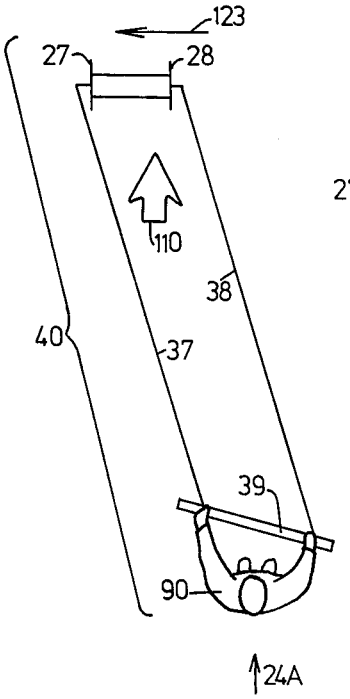
FIG.24
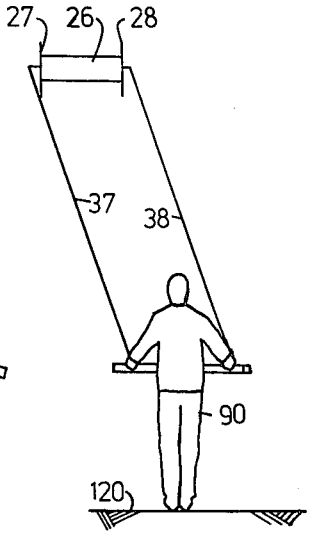

ACROBATIC ROTARY KITE

BACKGROUND OF THE INVENTION

1. Field of the Invention

The field of art to which this invention pertains is kites.

2. Description of the Prior Art

Prior art kite apparatuses are based on assumptions as to kite operations made on basis of substantially fixed conditions of wind velocity and direction and the operator's control of amount of direction and the operator's control of amount and direction of string tension. These are merely first approximations and a significant factor in actual practical operation of auto-rotating kites is that wind direction and intensity not only vary during the overall period of operation of such kites, e.g. 2 to 3 hours in one afternoon in use, and also during the short periods of time, as one minute, during which manuevering cycles are attempted, but also eddies and turbulent flow zones develop for brief periods and these variations are of sufficient magnitude as well as abruptness to significantly effect the orientation and position of such kite. Therefore, while changes in orientation and/or position made by the operator compensate for some atmospheric changes for which time to react is available, other changes occur sufficiently rapidly that operator intervention is not possible to meet the effects of conditions usually about 300 feet distant from where the operator stands as such changes are usually accomplished prior to the observer's visual and tactile observations of such change which observations are necessary for him to observe in order to effectively respond thereto.

Variations in wind speed for rotary kites particularly cause rapid up and down motions of the conventional rotary kite and cause transverse vertical wave forms of various size and longitudinal tension waves in the strings connecting the kite to the operator. Such vertical variations in string shape and longitudinal tension variations cause concomitant variations in the direction and amount of tension applied to the kite and interfere with the ability of the operator to control the movement of the kite (inasmuch as such control of movement of the kite by the operator is usually attempted to be effected by the applicant of varied amounts and direction of tension to the kite ends by the operator). When these oscillatory movements of the cord resulting from the rapid up and down movements of the conventional rotary kite (due to variations in wind velocity) occur there is resultant loss of kite control by the operator and a greater amplitude of variation of the kite from its normal or desired flight pattern occurs before the operator's corrective action can begin effectively; consequently greater time needs to be spent by the operator to achieving a balanced condition before any manueverability can be effective in systems as exist in conventional rotary type kites without the compensation provided for in the apparatus of this invention.

Prior art apparatuses using one two-edged vanes as U.S. Pat. No. 3,087,698 and 2,768,803 and 2,501,442 and 2,494,430 or diametrically balanced vanes as in U.S. Pat. No. 3,526,337 and 3,255,985 cyclically vary the pressure on the rotating core and vary the tension in the control cords from maximum pressure to substantially zero pressure during their cycle of operation and the lift effect provided by the core rotation varies from a maximum lift effect to a negative effect. Also, the instant of maximum upward air pressure force on the rotor during the rotation cycle due to wind pressure on the rotor and the instant of maximum lift effect in the cycle of rotation of the rotor do not coincide whereby pulsations of lifting force in the rotor and longitudinal stress on the control cords occur at different instants in the cycle of rotation of the rotor with resultant interfering vibrations in the control cords.

The kite of this kite invention has structures which correct for such usual defects and dampen usual longitudinal and transverse oscillatory motions in the control cords and accordingly improve the ease and reliability of control of the kite by the operator thereof.

SUMMARY OF THE INVENTION

Bearing connections between auto rotating kite and strings provides automatic correction for variations in rotor and wind speed to smooth effect thereof and utilizes tension along the length of one portion of each connector with another tension producing portion of that connector acting on that one portion transverse to the length of that one portion to resiliently maintain a connector surface position that minimizes interference of orientation of the kite relative to the cords attached thereto with the operation of the kite. This bearing and connector structure and functions are used with improved rudder, core and maneuvering structures and reduce oscillations that otherwise interfere with kite operation and control.

The overall combination kite structure comprises (a) a light weight core which is readily borne by light winds and provides small and evenly applied variations in cross sectional area to air flow applied thereagainst is of sufficient length and size to be sufficiently rapidly rotated as to support (b) large stabilizers, (c) rotatable connection to the cords that are widely spaced from the large stabilizers while rigid and (d) axle support structures that absorb and dampen usual abrupt vertical variations in rotor position and longitudinal stresses that would otherwise develop oscillations in the control cords, all combined in a structure that permits wide angles between axis of rotor and control cords without interfering with rotation of the rotor and a positioning of surfaces that minimizes effect of such intereference contact.

BRIEF DESCRIPTION OF THE DRAWINGS

FIG. 4 is an end view along direction of arrow 4A of FIG. 2.

FIG. 5 is a scale transverse sectional view along plane 5A—5A and is to scale.

FIG. 6 is an exploded view of the reel assembly of FIG. 7.

FIG. 7 is an oblique view of the reel assembly 139.

FIG. 8 is a sectional view of the structures along plane 8A—8A of FIG. 4.

FIG. 9 is a diagrammatic view partly in section along plane 9A—9A of FIG. 8.

FIG. 10 is a view along section 10A of FIG. 8 when the connector strip contacts the edge of stabilizer disc 28.

FIG. 11 is a diagrammatic sectional view along plane 11A—11A of FIG. 10.

FIG. 12 is a diagrammatic sectional view in Zone 12A of FIG. 8 during rapid rotation of core 26.

FIG. 13 is a diagrammatic sectional view as in FIG. 12 during a slower speed of rotation of core 26 than in FIG. 12.

FIG. 14 shows the system 40 with airborne kite 25 in its basic horizontal unskewed position.

FIG. 15 shows the system 40 with the airborne kite 25 displaced leftwards by a gust 101.

FIG. 16 shows the airborne kite 25 and system 40 in an early stage of self-correction of alignment in response to the gust 111.

FIG. 17 shows the airborne kite 25 and system 40 in a stage of self-correction of kite alignment and position subsequent to the stage shown in FIG. 16.

FIGS. 19–24 are diagrammatic representations of stages of the operation of the system 40 during control of the airborne kite by the operator thereof.

FIG. 19 is a diagrammatic front elevational view of an operator 90 maintaining the airborne kite in a tilted position as seen along direction of horizontal arrow 19A of FIG. 20.

FIG. 20 is a diagrammatic side view of system 40 along direction of arrow 20A of FIG. 19.

FIG. 21 is a diagrammatic rear elevational view along direction 21A of FIG. 22 of system 40 with operator 90 positioning the airborne kite 25 in an early stage of positioning its axis 29 at a non-transverse angle to the wind direction 110; FIG. 22 is a top or plan view of the system 40 shown in FIG. 21.

FIG. 23 is a top view of system 40 at a stage of positioning axis 29 of kite 25 subsequent to that stage shown in FIGS. 21 and 22 to move kite 25 at an angle to the wind direction 110 and FIG. 24 is a diagrammatic rear elevational view along direction of arrow 24A of FIG. 23 of positions of parts of the system in the stage shown in FIG. 23.

Figure 1:
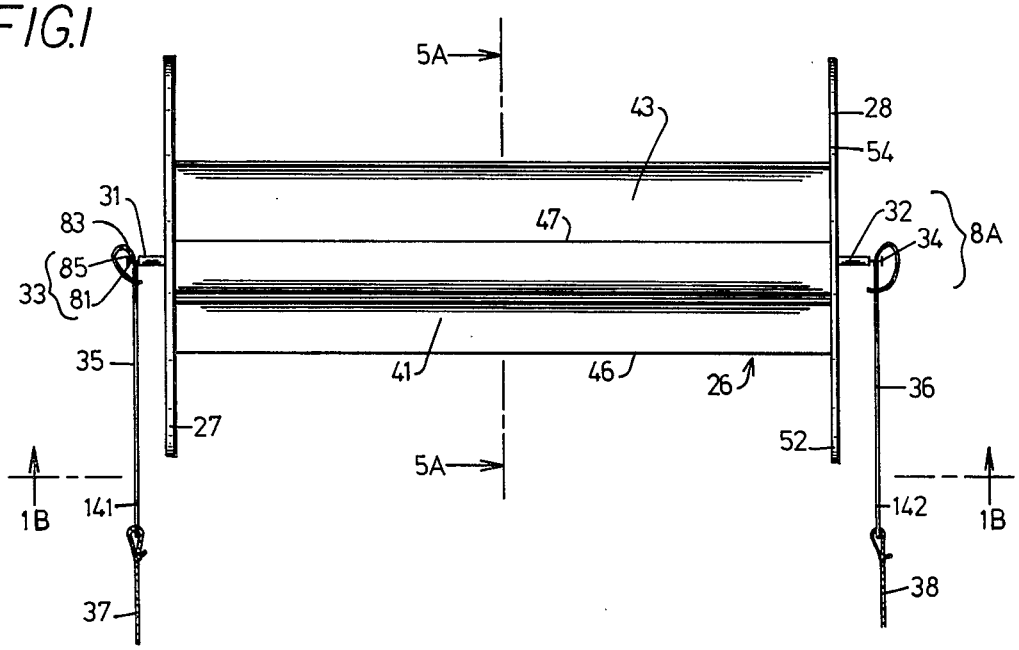
FIG. 1 is a top view of kite 25 along direction of arrow 1A of FIG. 18.
Figure 2:
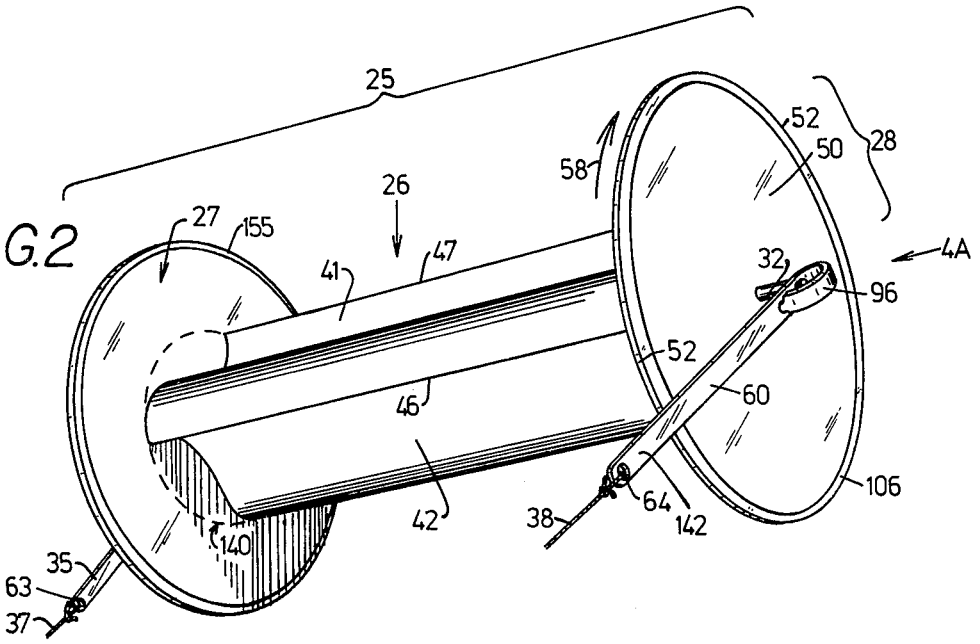
FIG. 2 is a bottom right oblique view and pictorial of kite 25 as seen along direction shown by arrow 2A of FIGS. 14 and 18.

The terms "left" and "right" as used herein refer to the left hand side ofthe apparatus 25 as shown in FIGS. 1 and 2.

The description given for one member of a set of like components as connector strip 36 and core surface 41 and right stabilizer disc 28 applies to the component described as like thereto, as, respectively, connector strip 35 and core surfaces 42 and 43 and left stabilizer disc 27.

Table I hereof (attached hereto as insert A) sets out dimensions and weights of components of the assembly 25.

DESCRIPTION OF THE PREFERRED EMBODIMENT

The apparatus system 40 (shown in FIG. 14) comprises the kite assembly 25, control strings 37 and 38 and a rigid control stick 39.

The kite assembly 25 comprises a rigid core body or wing 26, right and left stabilizers 27 and 28, and right and left connector strips 35 and 36 joined together as shown in FIGS. 1 and 2.

Core body or wing 26 is a rigid lightweight, e.g. styrofoam body with three like longitudinally extending peripheral surface portions 41, 42 and 43 of equal size, shape and area and each having peripheral sinusiodal shaped surfaces as measured in section transverse to the length of that surface as shown in FIG. 5. Each peripheral surface portion as 41, 42 and 43 referred to as front surface portion 41, rear surface portion 42 and bottom portion 43 as shown in FIG. 5 comprises an upwardly convex portion as 44 (and 44.2 and 44.3) contiguous and continuous with an upwardly concave portion 45, 45.2 and 45.3 of equal size but opposite shape. The body surface portions 41, 42 and 43 are joined at parallel adjoining body edges 46, 47 and 48 as shown in FIG. 5; these edges are therein referred to as front edge 46, top edge 47 and rear edge 48. At these edges the adjacent convex and concave surfaces 45.3, 44, 44.2, and 45 and 49.2 and 45.2 form angles 49, 49.1 and 49.2 respectively. These edges 46, 47 and 48 are equidistant from each other and equidistant from the central longitudinal axis 29 of the core body 26.

A central support shaft 30 which is a one-quarter inch diameter, solid, straight, cylindrical hard wooden shaft in the preferred embodiment 25 is located in the core body 26 coaxial with the central longitudinal axis 29 so that shaft 30 is located along a straight line parallel to and equidistant from the edges 46, 47 and 48. The body 26 is firmly joined to shaft 30 and acts as a mechanical ribbing agent for that shaft 30. Shaft 30 extends laterally at laterally projecting left end 31 and right projecting shaft end 32 beyond body 26 and plates 27 and 28.

Left stabilizer plate 27 and right stabilizer plate 28 are each flat, rigid, circular and their edges are coaxial with the support shaft 30 and the plates extend transversely to the support shaft and the plates are firmly attached to the left and right ends of the core body 26. Plates 27 and 28 have the same size and shape.

The shaft is located on the center of gravity of the body 26 and is located also along the center of gravity of the stabilizer plates 27 and 28.

The furthest point radial distance from axis 29 to each surface as 44 to the edge as 46 is 6.5 cm. The length of radius of edge of plate 28 is 12.5 cm. (from center 29).

A flat plane bisecting the 60° solid angle 49 between concave surface portion 44 and convex surface portion 45.3 at edge 46 extends at a 45° angle to a flat plane extending from that edge 46 to the center axis 29. A flat plane bisecting the 60° solid angle 49.1 between concave surface portion 45 and convex surface portion 44.2 at edge 47 also extends at a 45° angle to a flat plane line extending from the edge 47 to the central axis 29.

Additionally, the flat plane bisecting the 60° solid angle 44.2 between concave surface portion 45.2 and convex surface portion 49.2 at edge 48 extends at a 45° angle to a flat plane extending from the edge 48 to the central axis 29.

A cylindrical surface 141 defined by the rotation of edges 46, 47 and 48 about axis 29 has a transverse cross-sectional area shown as circle 140 in FIG. 2 of a 51¼ diameter, which area is far smaller than the area of each of the 10 inch diameter discs 27 and 28; each of discs 27 and 28 has an area 3.6 times the area of the circle 140. This large ratio of stabilizer disc area to the cylindrical cross-sectional area 140 provides a rudder action that cooperates with the rotor action to stabilize the core lift effect while the resiliently formed smooth surfaced connector pieces as 35 and 36 minimize the effect of high angles of the control string and the stabilizer disc outer faces as 54.

The convex surfaces 44, 44.2, and 44.3 are tangent at their edges 46, 47 and 48 (which are 4½ inches apart) with surface of circle 140.

Each of the surfaces 41, 42 and 43 is continuous between its edges and is sinusoidally shaped and has a straight line length of 4½ inches between its edges (as 46 and 47). Each curved surface as 41 has a maximum transverse amplitude of ¾ inch from a flat plane between its edges and is mirror image symmetrical about a straight line located midway between those edges 46 and 47.

Rigid like left and right tee-shaped nails 33 and 34 each respectively comprise a shaft 81 and 82 attached firmly to and co-axial with shaft ends 31 and 32 and heads 85 and 86 with exposed bearing surfaces 83 and 84. The total length of shaft 81 is 1 inch (2.54 cm.).

Connector strips 35 and 36 are mirror images of each other; accordingly the description of one applies to the other with referent numbers applied to components of strip 36 being one digit higher than the referent numbers applied to corresponding components of strip 35.

Figure 3:
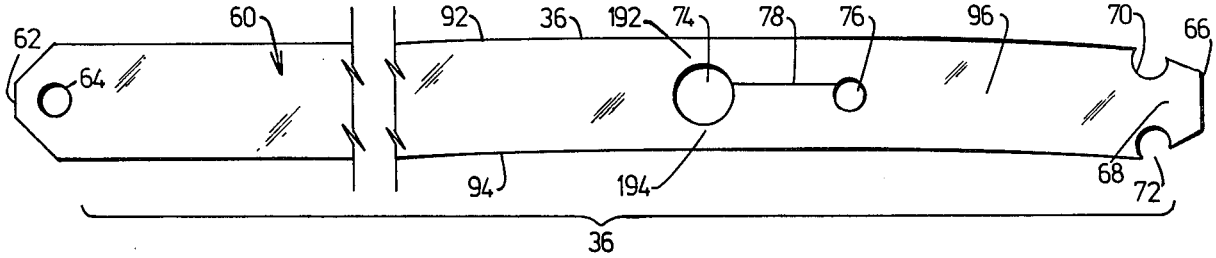
FIG. 3 is a diagrammatic showing of the connector strip 36 in its extended, flat, condition.

Connector strip 35 is a flexible resilient sturdy plastic strip with dimensions as in Table I and is diagrammatically shown in FIG. 3. The connector strip comprises a flexible, resilient dimensionally stable body 60 with three holes, 64, 74 and 76 therein and a tongue 68. Near one end, the cord connector end 62, of body 60 is a cord connector hole 64 as a means for connecting to the control string 38; near the other tongue end 66 of body 60, when open as shown in FIG. 3, is tongue 68. The tongue 68 is a terminal portion connected by the remainder of the body 60 of the connector strip 36 past a top upwardly open C-shaped notch 70 and a bottom downwardly open C-shaped notch 72. Between the notches 70 and 72 and the cord hole 64 are located two holes in body 60, a tongue hole 74 and the bearing hole 76; holes 74 and 76 are connected by a straight connector slit 78 therebetween. The bearing hole 76 is circular and located closer to the notches 70 and 72 than to the cord hole. The upper portion of tongue hole 74 is connected by the slit 78 to the top portion of bearing hole 76. The length of the strip body 60 from center of the cord hole 64 to the center of bearing hole 76 is slightly more (about ½ inch) than the distance from the nail shaft or axle 82 to the peripheral edge 52 of the stabilizer 28.

Hole 76 is spaced away from notches 70 and 72 by a portion 96 of strip 60, which portion 96 is formed into an elastically bent C-shape, as shown in FIGS. 2 and 8 in operative position of the kite 25 and strip 36 so that notches 70 and 72 then engage hole 74 as shown in FIGS. 2, 8 and 9.

The control stick 39 connectes by control cords 37 and 38, which are of equal weight, strength and length, to connector strips 35 and 36 by holes as 63 and 64. Control stick 39 is a rigid straight pole of 1 inch diameter. One end of each of cords 37 and 38 is attached to pole 39 spaced apart at the same distance as strips 35 and 36 are spaced apart by shaft 30 on nail shafts 81 and 82.

Alternative to the control stick 39 the reel assembly 139 in FIGS. 6 and 7 may be used for attachment to cords 37 and 38.

Generally, the large diameter portions 31 and 32 of the light weight relatively low density wooden shaft 30 provides a rigid lateral extension of large length on which to locate the high density small diameter small length steel bearing surfaces 81 and 82: such combination provides improved manueverability of apparatus 25 by increasing the distance of support (as at hole 76) for shaft 82 from face 54 of disc as 28 and so increases the angle as 100 between face 54 at edge 52 of the disc 28 and strip as 36 before contact between that disc edge and strip occurs as shown at FIG. 10. The smaller diameter shaft 82 so supported (a) allows the rotary motion of the shaft 82 relative to the bearing surfaces 102 therefor to minimize any otherwise developed rapid vertical oscillations developed by the rotor and affecting the cords during variations of wind speed and direction as well as (b) provide large angles of strip 36 relative to axle or shaft 30 to minimize effect of large diameter stabilizer discs when the angle as 115 in FIG. 15 of control cords of kite 25 is excessive as shown in FIGS. 10 and 11. Also, the resilient structure of connectors as 35 and 36 minimizes longitudinal oscillations in the cords 37 and 38. Details of the above are given below:

Each connector element as 35 and 36 comprises a flexible strip the dimensions of which are set out in Table I hereto. The connector element 35 and 36 are mirror images of each other and provide functionally significant features although the structures there of are apparently simple. A smooth-faced metal washer 104 is located on shaft 82 between portions of body 60 adjacent holes 76 and to the lateral end of right end portion 32 of shaft 30, as shown in FIG. 8. A similar washer is provided on shaft 81.

The rotatable connection between the rigid axle shaft as 82 and bearing surface 102 of hole 76 on the connector strip as 36 therefore is located, as shown in FIG. 8, adjacent the portion 96 of each elastically resilient connector strip as 36; this portion 96 in its operative position, as shown in FIGS. 2, 4, 8, 9 and 10, is bent in a curved shape with notches 70 and 72 engaging the hole therefor as 74. Thereby the location of the junction of each shaft as 82 and edge of hole therefor as 76 is lateral of the portion of body 60 of strip as 36 in which hole 74 is located. Thereby the portion of connector strip 36 to the rear (upward as shown in FIGS. 1 and 8) of hole 74, as shown in FIG. 8, is yieldably displaced laterally and slightly forward of its fully extended position by the laterally located resiliently bent portion 96, which laterally located portion is held by tongue 68 and notches 70, 72 to hole 74 and so provides a light yet reliable weather-resistant spring and resilient support for shaft 82 which serves to dampen the effect of variation of longitudinal stresses applied to edge of hole 76 by shaft 82 developed by wind force variation on core 26 on the control line 38 attached to hole 64; similar effects occurs for shaft 81, connector 35 and hole 63.

This looped structure of the connector strip as 36 (and 35) thus reduces longitudinal oscillation that would otherwise develop in control cord 38 (and 37) from rapid changes in rotation of rotor 26 by wind passing thereagainst and interfere with the operator's control of the movement of the kite 25.

Generally, the much larger diameter of the bearing surface of strip 60 than the diameter of shaft 84 of nail 32 shown in FIGS. 12 and 13 allows free rotation of strip 36 about a vertical axis passing through shaft 82 at the plane whereat surface 102 of hole 74 contacts shaft 82. More particularly, the large wide spacing of nail head 86 from end 32 of shaft 30 (5/16 inch or 4.0 mm. in the preferred embodiment) relative to the narrow (0.4 mm) thickness of the strip 36 applied to nail surface 84 at the bearing surface 102 of hole 76 of strip 74 allows the bearing strip surface 102 to be supported on nail shaft 82 at a wide range of angles relative thereto without contact with or scraping on (and development of frictional resistance on) vertical surfaces at the head of the nail or the shaft 31 hence allows a large angle between the line of extent of the control cord 38 (and 37) and the central longitudinal axis 29 of the core 26 and shaft 30.

In operation each connector strip as 36 passes the stress applied to its hole as 76 by nail shaft as 82 to hole 64 along the upper portion of body 60 because the shaft 82 bears against the upper portion of hole 76 adjacent edge 92, as shown in FIG. 12. The resilient characteristic of the loop 96 of the strip 60 also urges the tongue 68 laterally (rightward as shown in FIG. 11) and moves the lower edge 94 of the connector strip 36 outwardly more than its upper edge 92, as shown in FIGS. 9 and 11 inasmuch as the lower portion of the connector strip 36 adjacent lower edge 94 thereof has less tension applied thereto than does the upper portion thereof adjacent edge 94 and the slit 78 prevents tensile transfer of stress thereacross and because of the resilient forceful engagement by the bent portion 96 with upper tensioned portion 192 and lower (non-tensioned) portion 194 of body 60 adjacent to tongue hole 74. Thus tongue 66 preferentially moves outwardly the lower portion 194 of the strip 60; this creates an angle 56 between the inner surface 98 of the connector strip 60 and the outer surface 54 of the peripheral edge of the stabilizer disc 28. Thereby, when contact of the rotating disc edge 52 and interior surface 98 of the strip 60 occurs as shown in FIG. 11, contact occurs between a smooth surface, 98, and the interior surface of the connector strip and the smooth exterior surface 54 of the disc 28 at a line of contact at junction of planes forming an acute angle (56) with its apex directed at or pointed in the direction of movement 58 of the disc surface 54 relative to the interior strip surface 98, as shown in FIG. 11. This relation of angle 56 and surfaces 54 and 98, (there being a covering of the disc edge as 52 with a smooth hard plastic cover 106) avoids cutting of the edge of disc 28 or a high frictional force therebetween inasmuch as the strip surface 98 is held at an angle 56 directed in the direction of movement 58 of the disc 28 without any frictional stress on the axle as shaft 82. The structure of the connector strips thus provide for an orientation of the smooth hard connector strip which minimizes friction on contact thereof with the smooth hard plastic coated rotating stabilizer disc edge and without any binding action on the rotating axle or shaft 30.

The stabilizers in the apparatus 20 are of sufficiently large diameter to avoid a loss of the positive and negative pressure zones created by the rotation of the core to produce the lifting action above described. Also, in the apparatus of embodiment 25 the stabilizers 27 and 28 have a sufficiently large diameter to provide that the axis 29 of the shaft 30 will be kept oriented by the stabilizers to usually automatically maintain the axis 29 oriented so as to provide that the direction of the wind relative to the axis 29 is automatically and inherently maintained for a maximum and stable lifting action because the area of the 10 inch diameter discs 27 and 28 is 3.6 times the area of the 5 ¼ inches diameter circle in which edges 46, 47 and 48 lie.

The large diameter stabilizers 27 and 28 provide an improved automatic guiding or rudder response below discussed in regard to FIGS. 14–18 although they do provide an additional weight for the core 26 to support. However, the core 26 is made of such light-weight material that the weight of the stabilizers plates is readily accomodated and supported, while the entire structure 25 is still light enough to be rendered airborne at lower wind velocities than is usual for such type kites.

The connector strip hole 76 has a cylindrical bearing surface 102 which, on rapid rotation of rotor 26, is supported on the shaft 82 as diagrammatically shown in FIG. 12. The bearing surface 102 on the strip 36 is a smooth cylindrical surface which is of far greater diameter than the diameter of the shaft 82 which supports the connector strip. In airborne position of kite 25 the small diameter shaft 82 provides a support for the strip 36 by contacting the upper portion of the bearing surface 102 of the hole 76 and exerts an upward and leeward force thereon whereby the cord 38 is supported. Each bearing surface as 102 thus provides a curved downwardly concave track which the rotating core shaft as 82 engages. The force of cords 37 and 38 is transferred by such engagement to the core 26. For a given high wind speed and consequent force on the cords 37 and 38 the rotation and frictional force of each shaft surface as 82 causes such shaft to reach an dynamic equilibrium position on bearing surface 102 as shown in FIG. 12. However, as the speed of the rotor 26 and nail shaft surfaces 83 and 84 decreases the frictional force by surface 102 on the shaft surfaces 83 and 84 decreases and the shaft accordingly moves downward and leewards (to the right) as shown in FIG. 13. At such lower speed position the friction that in position of FIGURE was applied to the shaft 82 by surface 102 is reduced and the resistance to rotation of the core 26 is reduced. Thereby an automatic and rapid reduction in resistance to rotation of the core 26 results from this motion of the supporting shaft as 82 in the bearing surface therefor, as 102, each time there is a rapid reduction in wind force against rotor or core 26.

This structure of the small shaft diameter axle and the larger downwardly concave curved support therefor avoids sharp up and down movements of the kite rotor and the portion of the control cord attached thereto as 38 and corresponding rapid sharp vertical movement of the kits axis 29 relative to the cords 37 and 38 as might develop vertical oscillations in the cords 37 and 38 and concomitant interference with the control of kite 25 through cords 37 and 38 by an operator as 90. This self-correcting action as to vertical oscillation occurs rapidly and automatically without operation or movement of cords 37 and 38 on part of the operator 90.

As diagrammatically shown in FIG. 8, body 60 is, at rest, bent in vicinity of hole 76 so that the distance 118 from front edge of hole 74 to rear edge 126 of body 60 between hole 76 and notches 70 and 72 is 15/16 inch (distance 118 in FIG. 8) while the distance between (a) the rearward extension of the flat plane 128 tangent to upper edge 92 of portion 60 between holes 64 and 74, (which flat plane and its rearward extension, shown as 128 in FIG. 8, extend rearwardly of hole 76) and (*b*) the outermost portion 96, measured at a point 132 on portion 96 parallel to that plane 128, is ½ inch (such distance being shown as 134 in FIG. 8) and the distance of most rearward point, as 136 in FIGS. 12 and 13, on surface 102 of hole 76 is 3/32 inch lateral of plane 128. This distance from rear of hole 74 to rear point 136 of hole 76 is ½ inch when kite 25 is at rest; that distance is extensible elastically by a force of 1 to 10 pounds in string 38 when the tension from between holes 64 and 76 is increased due to stresses between cords as 38 and shaft 30 and by elastic bending of the portion 96 between holes 76 and 74 in the position of portion 96 as shown in FIGS. 2, 8, 9 and 10: such tensions occur between holes 64 and 76 due to force of shaft ends 31 and 32 on holes as 76 in connector strips as 35 and 36 during operation of the kite 25 resulting from wind action during operations as shown in FIGS. 14 to 24.

The overall combination of apparatus in kite 25 thus comprises (a) a light weight core which is readily borne by light winds and is constructed of sufficient length and size to be sufficiently rapidly rotated as to support (*b*) large stabilizers 27 and 28 (*c*) rotatable connection to strips as 36—as nail shaft 82 on shaft 32—that are widely spaced from the large stabilizers while rigid and (*d*) axle support structure (hole 76 in strip 36) that absorb and dampen usual abrupt vertical variations in rotor position and longitudinal stresses that would otherwise develop oscillations in the control cords, all combined in a structure that permits wide angles between axis of rotor and control cords without interfering with rotation of the rotor and a positioning of surfaces that minimizes effect of such interference contact.

The operation of this kite 25 is described in relation to the FIGS. 8–24. In such operation an operator 90 holds the control rod 39 which is firmly connected by the cords 37 and 38 to the connector strip 35 and 36 which are in turn rotatably connected to the axle 30 of the kite 25.

In operation the operator holds the rod 39 which holds cables 37 and 38 which connect to the connectors 35 and 36, which connect to the nail shafts 81 and 82 which are fixed to the shaft or axle 30 on each side of the core body 26. The air flow against the core 26 causes the core 26 to turn in a counter clockwise direction as shown in FIG. 5. The turning motion produces a positive or increased air pressure or air pressure in excess of atmospheric pressure at the bottom portion of the core 26 and a lower or negative air pressure or slight vacuum at the top of that rotating core. The resultant affect of both of these pressures is a lifting action on the core 26 which is proportional to the speed of rotation of the core about its axis 29. That lifting force is constant at (*a*) a given angle of the axis 29 to the horizontal and at (*b*) a fixed angle of the axis 29 the direction of the flow of air to the axis 29.

During operation of kite 26, as shown in FIGS. 14–24, the force of the wind on the three edged core 26 varies the total pressure on the core 26 transverse to its axis 29 and, so force on the central shaft 30 varies between different levels of tension but never falls to zero during the cycle of rotation of core 26 and the lift effect provided by the core 26 varies in range from a maximum lift effect to a lower but positive effect without falling to zero. During such operation, each time or instant of maximum air flow pressure force on the rotor transverse to axis 29 during the rotation cycle of rotor 26 due to wind pressure on the rotor 26 and the time or instant of maximum lift effect by rotor 26 in the cycle of rotation of the rotor 26 coincide.

Such concurrence of (*a*) pressure transverse to axis 29 which creates a torque in one direction (counterclockwise as shown in FIG. 5) and (*b*) maximum resistance to turning of rotor 26 created by the lifting effect of the air flow on rotor 26 which resistance creates a torque about axis 29 in the opposite direction, results in that these effects neutralize each other concurrently, hence substantially reduce cyclical speed variations of the rotor 26 and up and down motion of the rotor relative to the strips 35 and 36 and so reduce vertical oscillations in cords 37 and 38 that might otherwise interfere with control by operator 90 of the kite 25. Thus there is a substantially steady longitudinal stress in the supports as surface 102 of hole 76 in strip 36 for shaft end 32 and corresponding support in strip 35 for shaft and 31; such stress is free of cyclical sharp impulses due to sharp variations in impulse forces applied to shaft 30 during rotation of core 26.

The laterally extending rigid supports 32 of the control cords minimize vibration of the core 25 about its points of support (at shafts 81 and 82) on connector strips 35 and 36.

The connector strip 36 (and the like connector strip 35, which functions as does the connector strip 36 although a mirror image thereof) is relatively rigid in the vertical plane, hence such vertical oscillations as are applied to shafts 81 and 82 by the vertical movement of the rotating core 26 are dampened substantially prior to application of resultant of such tensions to cords as 38;

Additionally the frictional torque applied by shaft 82 to bearing surface as 102 of strip 36 (and like surface on strip 35) provides a yieldable force in a clockwise direction 58 as seen in FIG. 4 to the vertically rigid strip 36, which force also serves to dampen the effect of vertical oscillatory motion of the shaft 30 on the core 38 or 37 to which such strip (36 or 35 respectively) is attached.

The operation of apparatus 25 in system 40 is described in relation to diagrammatic FIGS. 14–24 wherein an operator 90 stands on ground 120 and holds a control stick 39 which is connected by the control cords 37 and 38 to the connector strips 35 and 36 which are in turn connected to the axle or shaft 30 of kite 25 through connectors 35 and 36 as above described. The wind blows in direction 110 from the operator 90 towards the kite 25 and causes a lifting of the kite 25 to a height 122 above the ground 120 as diagrammatically shown in FIG. 18.

The central longitudinal axis of rigid straight control stick 39 and the central longitudinal axis 29 of kite assembly 25 are then parallel and form right angles as 114 with the control cords 37 and 38 attached thereto. The straight rigid control stick 39 and kite 25 are then in line. By the phrase "in line" is meant that the kite 25 is a position whereat a vertical flat plane 124 parallel to the direction of air flow 110 extends from the contral line of the rod 39 and parallel to cords 37 and 38 and passes to a point equidistant from the plates 27 and 28 as at FIGS. 14 and 18.

Figures 14, 15, 16, 17, 18:
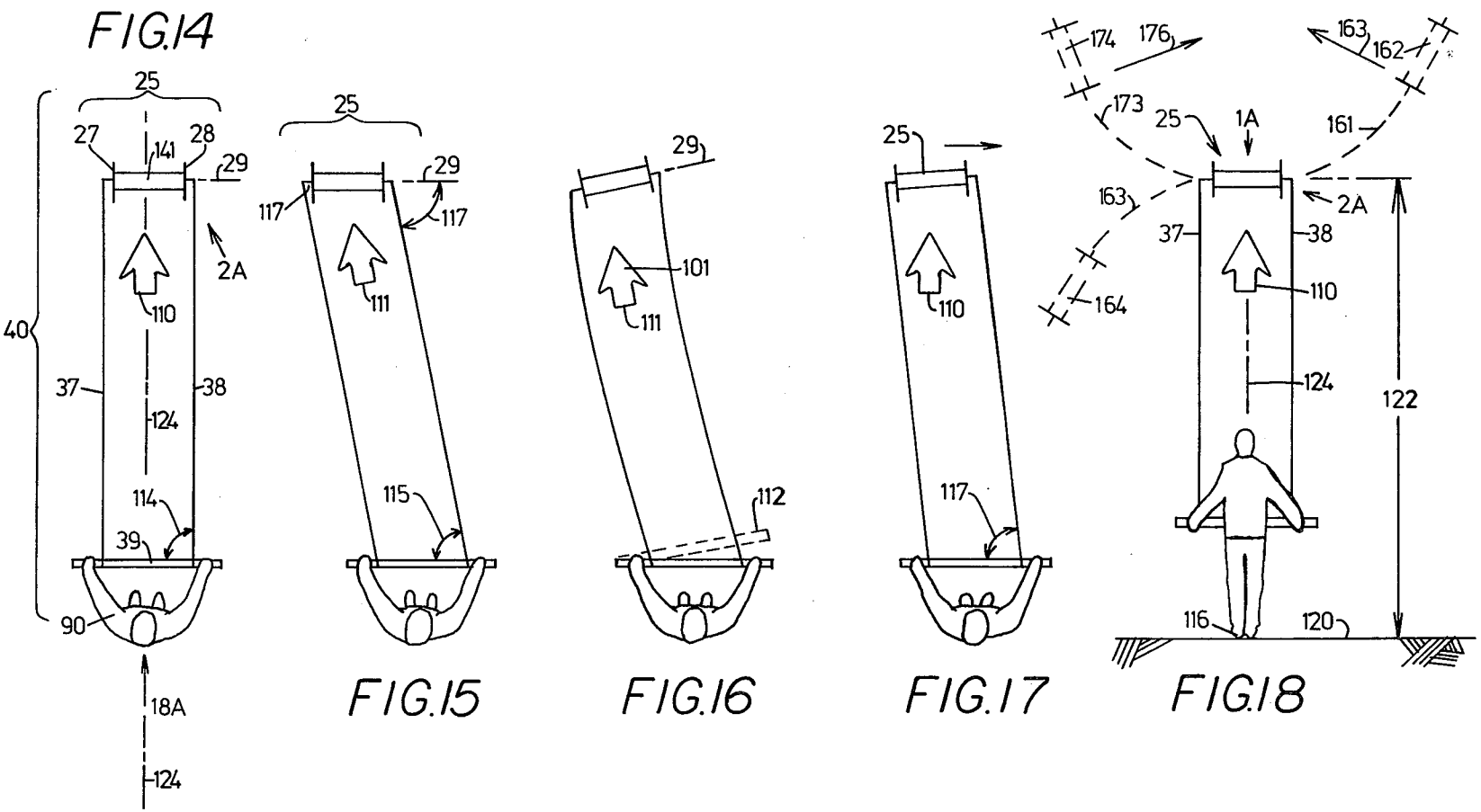
FIGS. 14 through 17 are a series of diagrammatic representations of stages of the operation of the system 40 of airborne kite 25 and operator 90 and control strings 37 and 38 and control stick 39 as seen from above.
FIG. 18 is a diagrammatic elevational view of the system 40 shown in FIG. 14 as seen along the horizontal direction 18A of FIG. 14.

When a horizontal gust of wind 101 is directed at an angle to the plane 124 it initially causes a lateral displacement of the kite as shown in FIG. 15 to the left of the operator 90 with the control rod 39, cords 37 and 38 and axle 30 forming a parallelogram with axis 29 and control stick or rod 39 parallel. The direction of travel 111 of the gust 101 is shown as directed leftwards of the direction of wind travel 110 in FIGS. 14 and 18.

Because the points of support of the connector strips 35 and 36 on nail shafts 81 and 82 respectively are widely spaced from the exterior face of the discs 27 and 28, the cords 37 and 38 develop large acute angles as 117 between cords as 37 and 38 and the axis 29 without, however, any contact between the connector strips 35 and 36 and the disc edges 155 and 106 of discs 27 and 28 respectively. When (a) angle 117 is developed between axis 29 with connector strips 35 and 36 (b) angle 115 is then also developed between cords 37 and 38 and the central line or axis of the straight rigid cylindrical control rod or stick 39 to which such control cords are attached; angles 115 and 117 are the same because cords 37 and 38 are at the same distance from each other at stick 39 as such control cords are from each other where they are attached to connectors 35 and 36 and the same distance is provided between the pivotal and rotatable attachment of connectors 35 and 36 to the nails 33 and 34. Because of the large surface area of the discs 27 and 28, the axis 29 of the kite 25 rapidly pivots relative to the direction of travel 111 of the gust 101 to a position of kite 25 as shown in FIG. 16 usually well before the angle 117 of the cords 37 and 38 and connector strips 35 and 36 to the discs 27 and 28 is sufficiently small that contact between such connector strips and the edge of such discs occurs as shown in FIG. 10. Accordingly, without such contact as is shown in FIG. 10 the planes of the stabilizer discs rapidly, i.e., within 1 to 2 seconds, approach being parallel to the wind direction 111 as shown in FIG. 16. The operator may subsequently and more slowly turn the control stick 39 to be parallel to the axis 29 as shown by dotted line 112 in FIG. 16 but, because of the rapid automatic movement of the axis 29 to align with the direction of wind flow, there is usually no contact of the connector strips as 35 and 36 with the rims 105 or 106. Where the sideways gust as 111 or change of direction is of short duration apparatus 25 provides that the same action of the large stabilizer surfaces on discs 27 and 28 provides that when the change of wind direction (from 110 to 111) subsides and the wind direction returns to its original direction 110 as shown in FIG. 17 the same structures of kite 25 provide that the kite 25 is returned to its position in line with the operator 90 as shown in FIGS. 14 and 18 and this change in orientation of the axis 29 is automatically and rapidly effected because of the rudder action of the large area stabilizer plates 27 and 28 relative to size and weight of core 26.

The same structural relationships of core 26 and stabilizers 27 and 28 plus the low ratio of weight of kite assembly 25 to the surface area of stabilizer discs 27 and 28 are used during maneuvering of the kite 25 by the operator 90.

The sideways manuevering operation of kite 25 is accomplished by the operator 90, while standing at the same position 116 on ground 120, moving the control stick 39 from (a) the position shown in FIGS. 14 and 18 wherein that stick extends in a direction transverse (at right angle 114) to the air flow direction 110 to (b) orientation of stick 39 and wind 110 whereat the angle between plane 124 and axis of stick 39 is an acute angle 125, i.e. by moving his left hand (holding left end of stick 39) forward in direction of wind 110 relative to the right hand, (which right hand firmly holds the right hand end of stick 39, as also is the case in the operation in all of FIGS. 14–24) and with both ends of stick 39 at the same vertical height and horizontal while the control lines or cord 37 and 38 are parallel to the wind flow direction 110 as shown in FIGS. 21 and 22. Such change in orientation of the control stick 39 and position of ends of control cords 37 and 38 cause a corresponding pivotal motion in the horizontal plane and change in the orientation of the axis 29 of the kite 25 to its orientation as diagrammatically shown in FIGS. 21 and 22: the resultant change of orientation of stabilizer discs 27 and 28 develops, in combination with the wind in direction 110, rudder or steering action by the stabilizer discs 27 and 28 and causes a rapid subsequent and automatic sideways movement or change of position relative to operator 90 of the shaft 30 and axis 29 of the kite 25 from the position shown in FIG. 21 with the result that the kite 25 moves to the left along direction of arrow 123 as shown in FIG. 23. This movement of kite 25 relative to operator 90 corresponds to the effect of a gust of wind coming from the operator's right as shown in FIG. 15. Accordingly, by moving the control stick 39 from its orientation shown in FIGS. 14 and 18 (normal to plane 124) to an orientation or position at an acute angle 125 to plane 124 as shown in FIG. 22, an operator may readily simulate the effect of a gust of cross wind as 111 and the movement of the kite to positions shown in FIGS. 23 and 24.

Reversing the change relations of stick 39 to plane 39 from these shown in FIGS. 21 - 24 relative to those shown in FIGS. 14 and 18 reverses the orientation of axis 29 shown in FIGS. 21 and 24 and the direction of kite movement (123) and change of position shown between the pair of FIGS. 21 and 22 and the pair of FIGS. 23 and 24.

For vertical manuevering of kite 25 the operator 90, while standing at position 116, moves the control stick 39 from its horizontal position shown in FIGS. 14 and 18 (parallel to the ground 120 and transverse to the air flow direction 110) to a position whereat that stick 39 is oriented at an angle 121 (upward to right) and at an angle 127 to the vertical 129 (in direction of wind travel 110 and upward) as shown in FIGS. 19 and 20.

Such change in orientation of the control stick 39 causes a change in position of ends of control cords 37 and 38 and a corresponding pivotal change in the orientation of the axis 29 of the kite 25 to its orientation as diagrammatically shown in FIGS. 19 and 20. The resulting change of orientation of stabilizer discs 27 and 28 and axis 29, in view of the large area discs 27 and 28, develops, in combination with the wind in direction 110, rapid and automatic change of position of the kite 25 along the upward direction of the arrow 119 as shown in FIG. 19. Accordingly, by moving the stick 39 from (a) its horizontal orientation shown in solid lines in FIGS. 14 and 18 with the stick 39 also at a right angle to the plane 124 in which plane 124 the line of direction 110 of the wind lies, as shown in FIGS. 14 and 18 to (b) an acute angle to the horizontal 121 and at an acute angle 127 to the vertical with stick 39 held lower at the operator's left side than at the operator's right side as shown in FIGS. 19 and 20, the operator 90 readily causes upward motion of the kite 25 to the right.

Upward motion of kite 25 occurs because the stabilizer disc plates 27 and 28 are directed at an acute solid angle to the direction of wind travel 110 with axis 29 directed upward as at angle 127 to vertical and, also, in the same direction 110 as the wind and sidewards and upwards relative to the horizontal is shown by angle 121 in FIGS. 19 and 20.

The kite 25 is arranged so that at any instant each concave surface as 45 adjacent the top edge as 47 of the core or rotor 26 is facing into the wind 110 each convex surface adjacent to the rear edge 48 faces downwards in all positions of kite 25 shown in FIGS. 14–24.

The upward and rightward motion described in relation to FIGS. 19 and 20 can be continued to provide a elevated kite position as 162 along a reversible path as 161 (shown in FIG. 18) by the operator maintaining the position as shown in FIGS. 19 and 20 for control stick 39 and axis 29.

A corresponding motion of kite 25 up and to left as along dotted path 173 shown in FIGS. 18 to an elevated position as shown by dotted lines at 174 is effected by positioning or orienting the left end of stick 39 forward of right end thereof as in FIGS. 21–24 with axis 29 at an angle as 127 in FIG. 20 to the vertical.

Tilting the axis of control stick or rod 39 from its position shown in FIGS. 14 and 18 to an acute upward and rearward angle 177 to the vertical as at position 179 in FIG. 20 with left end of stick 39 forward of the right causes the kite 25 to move downward and to the operator's left, along direction of arrow 175 of FIG. 19, and such movement may continue along path 163 to a position 164 as shown in FIG. 18, below the position in full lines.

A corresponding motion of kite 25 downward and to right is produced by tilting axis of stick 39 from position shown in FIGS. 14 and 18 to an acute upward and rearward angle to vertical as 177 with right end of stick 39 forward of left end as in FIG. 20 but lower than the left end.

The shape of cross-section (shown in FIG. 5) of the core 26 provides that the cross-sectional area measured along the vertical section 1B—1B of FIGS. 1 and 4 transverse to axis 29 and to direction of wind flow as 100 varies only from a maximum height of $4\frac{1}{4}$ to $4\frac{3}{4}$ inch so that the maximum variation in cross-sectional area is 71.2 to 79.6 square inches or an 11% variation of average transverse section to the air stream as 100. A maximum of one-half of this total variation of transverse cross-sectional area of core 26 occurs six times in each cycle of rotation of core 26 about axis 29 during operation of kite 25 and occurs sinusoidally between these limits.

The resultant small and gradually applied variation of stress is absorbed by the elastic action of connector strips 35 and 36 as the kite 25 rotates at 200–400 revolutions per minute about axis 29 at wind speeds of 20–40 miles per hour in position of FIGS. 14 and 18. The kite 25 is airborne at 15 miles per hour winds at direction 100 relative to axis 29 because of the average light weight; (i.e., 1.5 gram per unit square inch of cross-section at section 1B—1B with range of 1.43 to 1.6 grams) per square inch of section 1B—1B over the cycle of rotation of core 26.

FIG. 5 shows the position of core 26 whereat the minimum transverse section is placed in path of flow of a horizontal stream of air 107; the distance 105 from the top 150 of convex curved portion 44.2 to level of bottom of convex curved portion 44.3 and edge 46 is then vertical and is the vertical measure of the minimum transverse section of core 26 presented to air flow therepast and is parallel to plane 1B—1B of FIGS. 1 and 4.

When air flow or air stream is directed at core 26 in a direction as arrow 107 at the instant of operation shown in FIG. 5 which direction lies in a flat plane then passing through axis 29 and perpendicular to the minimum transverse section of core 26, and which air flow direction is perpendicular to axis 29 the counterclockwise impulse or torque or turning force on (surface 45 of) core 26 of such air stream 107 at such instant in rotation cycle of core 26 is then at its maximum value, while the downward or lifting force of core 26 and resultant clockwise reaction torque developed by (the convex surface 44.3 of) that core 26 is also at its maximum; this opposing concurrent force to turning of the core 26 minimizes any potential change on rotary speed of the core 26 due to the maximum turning force (against surface 41) then applied to the core 26 and minimizes abrupt speed change at core 26 at such instant.

When air flow of an air stream is directed at core 26 in direction as 108 in FIG. 5, (which situation occurs as core 26 rotates 60° counterclockwise from its position shown in FIG. 5 and the air stream continues in same direction as theretofore) which direction of air stream then lies in a direction as 108 which (direction of air stream) lies in a flat plane passing tangent to edge 47 and top of convex surface portion 44, the counterclockwise impulse or turning or torque force at such instant in cycle of rotation of core 26 is then at its minimum volume while the lifting force applied by core 26 against the atmosphere is then also at its minimum; such relative absence of opposition by the lifting force on the core 26 to the turning force applied to the core 26 provides minimum interference with the rotation speed thereof at such instant.

At the instant in the rotation cycle of core 26 when the direction of the air stream relative to the core 26 is in the direction of arrow 107 of FIG. 5, the vacuum developed by core 26 is at its minimum but the downward pressure developed by core 26 as at its minimum so that the net vertical force developed by core 26 provides no sharp upward or downward force; similarly at the instant in the rotation cycle of core or wind 26 when the direction of air stream relative to the core 26 is in the direction of arrow 108 of FIG. 5 the vacuum developed on top of core 26 is at its maximum and the downward pressure exerted by the core 26 on the atmosphere therebelow and consequent lifting force on the core is at its maximum value, whereby the net vertical force developed by core 26 provides no sharp upward or downward force at such instant. The curvature of surfaces 41, 42 and 43 make gradual the force changes on core 26 between the positions of the core 26 between the relative positions of air stream direction as 107 and 108 and the core 26.

Accordingly, the tensile forces applied between cords 37 and 38 and connector strips 35 and 36 are substantially free of oscillatatory motions developed by rotation of the core 26 and discs 27 and 28 and shaft 30. Accordingly, the operator has full control of the direction or movement of the kite 25, i.e., to left and right and up and down and in combinations, though such control is accomplished by only small differences is tension along cords 37 and 38 and positioning of ends of control cords by only very changes, e.g. fractions of an inch as above described, so that oscillations used in rotary kites in the usual 100 to 300 feet long cords 37 and 38 would seriously interfere with and make impractical the acrobatic movements above described in relation to FIGS. 14–24 readily achieved by the system 40.

In view of the usual vertical force created transverse to axis 29 by the rotation of core or wing 26 due to action of the wind thereon, the kite 25 may also be controlled to move in left and right sideways directions 176 and 163 from positions 174 and 162 respectively by manipulating cords 37 and 38 so as to pivot the upper end of the sideways and upwardly tilted axis 29 of assembly 25 a small amount in the direction of such desired movement. Although such maneuvers require a delicate or small movement of the ends of the cords 37 and 38 attached to strips 35 and 36 such manipulations and controls, like the other manipulations of the airborne kite 25 above described, are readily accomplished by assembly 50 due to the absence of interfering oscillations and tension changes in the cords 37 and 38 due to operation of the airborne kite assembly 25, and the ligth weight (four ounces) borne by the large areas (78.5 square inches) of each stabilizer disc, as 27 and 28, in the vertically extended position of the axis 29 of the airborne assembly 25 in its position shown as 162 and 174 in FIG. 18.

In the event that such movement as in FIGS. 14–24 of the kite 25 does cause a contact of the peripheral edge as 52 of the plates 27 and 28 with connector strip as 35 and 36 not only does the above described angular relationship of the surface 98 of the connector strip to the edge 52 of each stabilizer plate as 28 minimize any lowering of the rotational speed of the disc but also the outer edge 52 or stabilizer plate 28 is provided with a smooth strong plastic rim 106 such as plastic electrical tape to reduce friction thereof with the surface as 98 whenever the strip as 36 contacts such stabilizer plate. The stabilizer plate 27 has a similar smooth yet tough surface 155 on its peripheral radial edge. Further, each strip 36 (and strip 35 also) is sufficiently flexible that it readily and elastically bends, as shown diagrammatically at the portion 142 in FIG. 10 of strip 36 which extends beyond the point, as 144 on rim 106 whereat there is contact between surface 98 and rim 106. As this bent portion thereof the strip 36 is softly curved and smooth surfaced so there is minimal friction therebetween and no resultant damage to the rim 106 or edge 52 of the plate 28 from such contact, notwithstanding the usual substantial tension (two to ten pounds) in such strings as 37 and 38 during airborne operation of kite 25 in high winds (30–50 m.p.h). Also, because of such smooth and flexible structure of the elements 35 and 36 there is no tearing (as might occur with strings alone) into disc as 27 or 28 and no such engagement of element (35 or 36) and disc or rim as prevents immediate rapid turning of the wing or core 26 and airborne operation of kite assembly 25 as soon as the axis of the assembly 25 is brought to an orientation relative to the cords 37 and 38 which releases the engagement of cord and stabilizer disc.

The dual string control reel assembly 139 comprises a rigid straight control stick 180, circular string reels 181 and 182 and a reel mount plate 183. Stick 180 has the same cross-section (transverse to its length) from one end thereof to the other as does stick 39. Reel mount frame 183 is a rigid flat plate firmly held to stick 180 as by nails 165–168 and has a bearing hole 191 therethrough normal to length of stick 180. The reels 181 and 182 are rigid, coaxial, of equal size and thickness and extend parallel to the length of stick 180 and are firmly joined together and are firmly attached to and supported on a rigid straight axle arm 185 or a rigid J-shaped bolt 184. A longer arm 185 of the J-shaped bolt 184 serves as an axle and passes through a hole 145 in center of reel 182 and a like hole in reel 181 and a bearing hole 191 in reel mount frame 183.

A short rigid crank arm 186 has holes 159, 156 and 189 therein. A bolt 197 is rotatably supported in bolt hole 159 therefor in crank arm 186 and is firmly fixed to a winding knob 187. The longer arm 185 of J-bolt 184 passes through hole 156 and is rotatably supported in bearing hole 191 of plate 183 and held in place by lock nut 195, with washers 198 and 199 located on each side of plate 183 on shaft 185.

The shorter arm 188 of J-bolt 184 passes through holes 189 in crank arm 186 and a hole 190 in reel 182 and a like hole in reel 181 whereby the reels as 181 and 182 and crank arm 186 all rotate smoothly together about arm 185 in bearing hole 191. Eyescrews 157 and 158 are firmly attached to the bottom face of control stick 180 near to the left and right ends respectively thereof. Control strings 37 and 38 pass respectively through the holes therefor in eyescrews 157 and 158 to attach to reels 181 and 182 respectively. The axis of the hole in each of the eyescrews 157 and 158 faces the reel to which the cord therein is attached. The hole 191 is located below the center of the stick 180 midway between eyescrews 157 and 158.

The cords 37 and 38 are firmly wound around control stick 39 or on reels 181 and 182 to shorten the length thereof between the kite 25 and the operator 90; such cords may also be slowly wound from stick 39 or from the reels 181 and 182 while keeping those strings free of looseness so that they play out evenly.

The loose relation and fit of shaft 82 in bearing surface 102 (0.5 mm for a 1.7 mm diameter shaft) provide that the shaft as 82 may shift its position as shown in FIGS. 12 and 13 so that the larger total force 147 required for equilibrium at high rotating speeds of core 26, applied at an angle 146 to the horizontal is reduced when the shaft 82 shifts to a lower position as in FIG. 13 at lower speed of core 26 with consequent lower equilibrium force 148 and lesser angle to direction of force 138 along length of connector strip 36 and cord 38 whereby the frictional force on support surface 102 of connector 36 (and like force in connector 35) varies as the speed of location of core 26 varies.

Because of its ability to maintain stability and orentation in high winds, this system has utility as an antenna in high wind situations using one of the control cords as a propagator.

TABLE I

| | | | |
|---|---|---|---|
| Kite assembly 25 total weight | | 4 ounces | 113.4 gm. |
| disc 27 +rim 106 | diameter | 10 in. | 25.4 cm. |
| | weight | 1.25 oz. | 35.5 gm. |
| | thickness | .125 in. | 3.2 mm. |
| rotor 26 +shaft 30 | weight | 1.5 oz. | 42.6 gm. |
| | length of edge 41 | 16-3/4 in. | 42.6 cm. |
| | circle 140 diameter | 5.25 in. | 13.3 cm. |
| shaft 30 | total length | 19-1/8 in. | 48.6 cm. |
| | portion 31 length | 1-3/16 in. | 3.0 cm. |
| | diameter | .245 in. | 6.2 mm |
| | material | wood | |
| | density | .4 spec. | gravity |
| nail 34 | diameter of shaft 81 | .064 in. | 1.6 mm. |
| | head 86 - diameter | .185 in. | 4.7 mm. |
| | thickness | .016 in. | .4 mm. |
| | material | steel | |
| | density | 7.9 spec. | gravity |
| strip 36 | length (edge 62 to edge 66) | 8-1/16 in. | 20.5 cm. |
| | thickness | .012 in. | .3 mm. |
| | height (edge 92 to edge 94) | 1/2 in. | 12.7 mm. |
| | material | polyethylene | |
| | density | .92 spec. | gravity |
| hole 74 | diameter | 3/16 in. | 4.8 mm. |
| | top of hole 74 to edge 92 | 9/64 in. | 3.5 mm. |
| | bottom of hole 74 to edge 94 | 12/64 in. | 4.5 mm. |
| slit 78 | length (front of hole 76 to rear of hole 74) | .4 in. | 10 mm. |
| | distance below edge 92 | 7/32 in. | 5.5 mm. |
| | distance above edge 94 | 9/32 in | 7.5 mm. |
| hole 76 | diameter | 5/64 in. | 2.2 mm. |
| | distance of top below edge 92 | 15/64 in. | 5.9 mm. |
| | distance from rear | | |

TABLE I-continued

| | | | |
|---|---|---|---|
| | edge to edge 66 | 1-7/8 in. | 4.6 cm. |
| hole 64 | diameter | 11/64 in. | 4.4 mm. |
| | distance front edge to edge 62 | 13/64 in. | 5 mm. |
| | distance top edge to edge 92 | 5/32 | 4 mm. |
| notch 70 | diameter | 12/64 in. | 4.5 mm. |
| | length across opening | 11/64 in. | 4.2 mm. |
| | depth of opening to bottom of notch | 11/64 in. | 4.2 mm. |

I claim:

1. A rotary kite system comprising, in operative combination, a. a three-edged core having three like radial surfaces joined at three parallel longitudinally extending edges and two end surfaces transverse to said edges, said edges being straight and located axially symmetrically and parallel to a central longitudinal core axis, each radial surface of said core between each two of said edges being smooth, continuous and composed of an outwardly convex surface and an outwardly concave portion in series, b. two circular thin stabilizer discs each co-axial with and extending transversely of said axis and having a radius greater than the distance between said parallel core edges, one of said discs firmly attached to one end surface of said core and the other disc attached to the other end surface of said core, the circular edge of each of said discs having a smooth exterior surface, c. a rigid shaft in said core extending through and laterally of said core, one end of said shaft extending laterally beyond one of said discs and the other end of said shaft extending laterally beyond the other of said discs, said discs having a flat outer surface, d. a rigid control stick having, adjacent to the ends thereof, the same cross-section transverse to its length, e. two spaced apart flexible control cords, one of said cords attached to one end of said control stick and, at the other end thereof, to one end of said shaft, the other cord attached at one end thereof to the other end of said control stick and, at the other end thereof, attached to the other end of said shaft, f. a small diameter hard surfaced rigid bearing shaft located at each end of said shaft extending from said core and coaxial with and extending laterally of and fixed to each end of said shaft, and having a smaller diameter than said shaft g. a connector rotatably attached to one of said smaller diameter shafts and to one said flexible control cords, and a like connector attached to the other of said small diameter shafts and to the other of said control cords, h. each said connector comprising a longitudinally extending resilient strip having a smooth surface and comprising a bearing surface on which one of said rigid bearing shafts is rotatably located, and a means for attachment of said connector to one of said control cords and to which means said control cord is attached, said smooth surface on said strip facing a smooth surfaced edge of one of said discs, and i. said strip extending transversely to said axis of said core from said small diameter hard surfaced bearing shaft a greater distance than the radius of said disc, and being resiliently flexible transversely to the length of said strip.

2. Apparatus as in claim 1 wherein said smooth surface of said connector strip is supported at an angle to the surface of said disc, which angle is acute in the direction passing from a convex portion to a concave portion of each said radial core surfaces.

3. Apparatus as in claim 2 wherein said bearing surface has a diameter 0.5 mm. larger than the diameter of the rigid bearing shaft located therein.

4. Apparatus as in claim 2 wherein the connector strip is a flexible resilient dimensionally stable body with a top edge, a bottom edge and three holes located at differing positions along the length of the body between those edges and a first, cord, end and a second, tongue, end on said body; one, first, cord connector hole located near the first, cord end of said strip; a top, upwardly open, C-shaped notch in said upper edge and a bottom, downwardly open, C-shaped notch in said lower edge at the same distance along the length of said connector strip body from said tongue end; a tongue portion of said body connected to the remainder of said strip body on a side of said connector strip between said notches and said tongue end; said second, tongue, hole located between said notches and said cord hole; and a third, bearing, hole located between said tongue hole and said notches; and said bearing hole is spaced away from said notches by an elastically bent portion of said strip body which is formed into an elastically bent C-shape, and said notches pass through said tongue hole and the portions of said strip adjacent said notches firmly engage portions said strip adjacent said tongue hole.

5. Apparatus as in claim 2 wherein total weight of the core, shaft and discs per unit transverse sectional area of the core measured transversely to said central longitudinal core axis is in range of 1.43 to 1.6 grams per square inch of such sectional area.

6. Apparatus as in claim 4 wherein total weight of the core, shaft and discs per unit transverse sectional area of the core measured transversely to said central longitudinal core axis is in range of 1.43 to 1.6 grams per square inch of such sectional area.

7. Apparatus as in claim 2 wherein the total weight of the core, shaft and discs is in range of 4 to 5 ounces per 80 square inches of surface area of each of said discs.

8. Apparatus as in claim 6 wherein the total weight of the core, shaft and discs is in range of 4 to 5 ounces per 80 square inches of surface area of each of said discs.

9. Process of control for an airborne rotary kite having a rotating core and end discs comprising steps of passing air stream in a first direction over said rotating core transverse to axis of rotation thereof while varying the transverse section of the core relative to the direction of said air stream no more than 11% of said transverse sectional area and supporting said rotating core against said air stream by a pair of spaced apart control cords rotatably connected to said kite at points spaced apart along said axis of rotation and varying the frictional force on supports for said core directly as its speed of rotation varies and resiliently dampening vertical variations in tension developed by said rotation before applying said vertical tension to said control cords and dampening longitudinal variations in tension developed by action of said wind on said rotating core before applying said longitudinal tension to said control cord.

10. Process as in claim 9 including the step of resiliently maintaining tension bearing members, which pass from the rotating core to said control cords and which extend beyond the edge of the discs, at an acute angle to the discs, said acute angle measured in the direction of said rotation of said core.

* * * * *